US008671706B2

(12) United States Patent
Chin et al.

(10) Patent No.: US 8,671,706 B2
(45) Date of Patent: Mar. 18, 2014

(54) HEAT PUMP

(75) Inventors: Simwon Chin, Changwon-si (KR); Eungyul Lee, Changwon-si (KR); Younghwan Ko, Changwon-si (KR); Sangkyoung Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 840 days.

(21) Appl. No.: 12/846,626

(22) Filed: Jul. 29, 2010

(65) Prior Publication Data

US 2011/0113804 A1 May 19, 2011

(30) Foreign Application Priority Data

Nov. 18, 2009 (KR) ..... 10-2009-0111603

(51) Int. Cl.

| | |
|---|---|
| ***F25B 13/00*** | (2006.01) |
| ***F25B 5/00*** | (2006.01) |
| ***F25B 1/10*** | (2006.01) |
| ***F25B 43/00*** | (2006.01) |
| ***F24F 3/153*** | (2006.01) |

(52) U.S. Cl.

CPC ..... *F24F 3/153* (2013.01); *F25B 2400/13* (2013.01); *F25B 2600/0251* (2013.01)

USPC ..... 62/324.6; 62/117; 62/510; 62/513

(58) Field of Classification Search

USPC ..... 62/324.6, 117, 196.1, 510, 513, 512, 62/324.3

See application file for complete search history.

(56) References Cited

U.S. PATENT DOCUMENTS

| | | | | |
|---|---|---|---|---|
| 6,460,371 | B2 * | 10/2002 | Kawada | 62/505 |
| 8,424,326 | B2 * | 4/2013 | Mitra et al. | 62/196.1 |
| 2006/0225445 | A1 * | 10/2006 | Lifson et al. | 62/175 |

FOREIGN PATENT DOCUMENTS

| | | | |
|---|---|---|---|
| CN | 1349079 | | 5/2002 |
| JP | 2001-330360 | A | 11/2001 |
| JP | 2002-188865 | A | 7/2002 |
| KR | 10-2008-0031315 | A | 4/2008 |
| WO | WO 2008130357 | A1 * | 10/2008 |

* cited by examiner

*Primary Examiner* — Chen Wen Jiang

(74) *Attorney, Agent, or Firm* — McKenna Long & Aldridge LLP

(57) ABSTRACT

A heat pump according to the present invention comprises a plurality of the compression chambers, and compresses refrigerant with multistage, and injects vapor refrigerant into the space between the plurality of the compression chambers by using the first refrigerant injection flow path and the second refrigerant injection flow path. Performance and efficiency of the heat pump can be improved compared with non-injection, as flow rate of the refrigerant circulating the indoor heat exchanger is increased. Thus heating performance can be improved also in the extremely cold environmental condition such as the cold area by increasing the injection flow rate. Also, because the heat pump according to the present invention comprises the first refrigerant injection flow path and the second refrigerant injection flow path, refrigerant is injected twice. Thus, as the injection flow rate of the refrigerant is increased, heating capacity can be improved. Also, the difference between the suction pressure and the discharge pressure of the rotary compressor may be decreased, and thus the reliability and the performance of the rotary compressor can be improved.

13 Claims, 9 Drawing Sheets

HEAT PUMP

This application claims priority from Korean Patent Application No. 10-2009-0111603 filed on Nov. 18, 2009, in the Korean Intellectual Property Office, the disclosure of which is incorporated herein by reference in its entirety.

BACKGROUND OF THE INVENTION

1. Field of the Invention

The present invention relates to a heat pump, and more particularly, to a heat pump that performance and efficiency can be improved.

2. Description of the Conventional Art

In general, a heat pump is a device which cools or heats an indoor space by performing compression, condensation, expansion, and evaporation process of refrigerant.

Heat pumps are classified into standard air conditioners which have one indoor unit connected to one outdoor unit and multi-type air conditioners which have a plurality of indoor units connected to at least one outdoor unit. Also, heat pumps further comprise a water heater to supply hot water and a heater to heat a floor by using hot water.

The heat pump comprises a compressor, a condenser, an expansion valve and an evaporator. Refrigerant is compressed at the compressor, is condensed at the condenser, and then is expanded at the expansion valve. The expanded refrigerant is evaporated at the evaporator, and then flows into the compressor.

But, the conventional heat pump has a problem that the cooling/heating performance is not sufficient to cool/heat a room, when cooling/heating load such as outdoor temperature is changed. For example, in the cold area, heating performance is extremely reduced. If the existing heat pump is changed into the new heat pump having larger capacity or an extra pump is added to the existing heat pump, it needs high cost and large space for installing.

SUMMARY OF THE INVENTION

An object of the present invention is to provide a heat pump that cooling and heating performance can be improved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heat pump comprising: a main circuit which comprises a rotary compression device having a plurality of compression chambers and a condenser for condensing refrigerant passed through the rotary compression device and an expansion device for throttling refrigerant passed through the condenser and an evaporator for evaporating refrigerant expanded by the expansion device; a first refrigerant injection flow path which is bypassed at the space between the condenser and the evaporator and injects refrigerant to one of the plurality of compression chambers; and a second refrigerant injection flow path which is bypassed at the space between the condenser and the evaporator and injects refrigerant to the other of the plurality of compression chambers.

In the present invention, the rotary compression device comprises a rotary compressor which has a plurality of compression chambers formed in a body, and each of the first refrigerant injection flow path and the second refrigerant injection flow path respectively inject refrigerant to the spaces between a plurality of compression chambers.

In the present invention, the rotary compression device comprises a first rotary compressor which has a low pressure compression chamber and a high pressure compression chamber in a body and a second rotary compressor which has a compression chamber in a body, and one of the first refrigerant injection flow path and the second refrigerant injection flow path injects refrigerant to the space between a low pressure compression chamber and a high pressure compression chamber, and the other of the first refrigerant injection flow path and the second refrigerant injection flow path injects refrigerant to the compression chamber of the second rotary compressor.

In the present invention, the rotary compression device comprises three rotary compressors which are connected in series and have a compression chamber in a body respectively, and the first refrigerant injection flow path and the second refrigerant injection flow path respectively inject refrigerant to each of the spaces between the three rotary compressors.

In the present invention, the expansion device comprises a first expansion device which is disposed between the condenser and the first refrigerant injection flow path and a second expansion device which is disposed between the second refrigerant injection flow path and the evaporator, and the first refrigerant injection flow path is connected between the first expansion device and the second expansion device, and the second refrigerant injection flow path is connected between the first refrigerant injection flow path and the second expansion device.

In the present invention, any one of the first refrigerant injection flow path and the second refrigerant injection flow path comprises a phase separator which separates refrigerant expanded at the expansion device into liquid refrigerant and vapor refrigerant.

In the present invention, any one of the first refrigerant injection flow path and the second refrigerant injection flow path comprises an internal heat exchanger which exchanges heat of refrigerant expanded at the expansion device and a refrigerant control valve which throttles refrigerant passed through the internal heat exchanger.

In the present invention, the internal heat exchanger comprises a first refrigerant pipe and a second refrigerant pipe which is formed to surround the first refrigerant pipe, and any one of the refrigerant flowing from the expansion device to the evaporator and the refrigerant injecting into a plurality of compression chambers passes through the first refrigerant pipe and the other refrigerant of those passes through the second refrigerant pipe.

In the present invention, the first refrigerant injection flow path comprises a phase separator which separates refrigerant expanded at the expansion device into liquid refrigerant and vapor refrigerant, and the second refrigerant injection flow path comprises an internal heat exchanger which exchanges heat of refrigerant passed through the phase separator.

In the present invention, the first refrigerant injection flow path comprises a first heat exchanger which exchanges heat of the refrigerant flowing from the expansion device to the evaporator for heat of the refrigerant bypassed from the expansion device to the first refrigerant injection flow path, and a first refrigerant control valve which throttles the refrigerant passing through the first refrigerant injection flow path;

and the second refrigerant injection flow path comprises a second heat exchanger which exchanges heat of the refrigerant flowing from the expansion device to the evaporator for heat of the refrigerant bypassed from the expansion device to the second refrigerant injection flow path, and a second refrigerant control valve which throttles the refrigerant passing through the second refrigerant injection flow path; and the first heat exchanger and the second heat exchanger are formed to one unit.

In the present invention, the heat pump further comprises a triple pipe heat exchanger which is disposed at the space between the first expansion device and the second expansion device and comprises a first refrigerant pipe forming the first refrigerant injection flow path and a second refrigerant pipe surrounding the first refrigerant pipe and forming a passage which the refrigerant expanded at the first expansion device passes through and a third refrigerant pipe surrounding the second refrigerant pipe and forming the second refrigerant injection flow path.

In the present invention, any one of the first refrigerant injection flow path and the second refrigerant injection flow path comprises a phase separator which separates the refrigerant expanded at the expansion device into the liquid refrigerant and the vapor refrigerant, and the other of the first refrigerant injection flow path and the second refrigerant injection flow path comprises an internal heat exchanger which is disposed inside of the phase separator and absorbs the heat generated from the inside of the phase separator.

In the present invention, each of the first refrigerant injection flow path and the second refrigerant injection flow path comprises a first refrigerant control valve and a second refrigerant control valve respectively which throttles the refrigerant injected into the rotary compression device, and the heat pump further comprises a controller which controls opening degree of the first refrigerant control valve and the second refrigerant control valve.

In the present invention, if the heat pump is started, the controller controls that the expansion device is started and the first refrigerant control valve and the second refrigerant control valve are closed, and then, if the start control of the expansion device is finished and the refrigerant injection is demanded, the controller controls that the first refrigerant control valve and the second refrigerant control valve are started to be opened.

In the present invention, the controller controls that at least any one of the first refrigerant control valve and the second refrigerant control valve is selectively opened according to the demand load of the heat pump.

In the present invention, the controller controls that the first refrigerant control valve and the second refrigerant control valve is opened in sequence according to the demand load of the heat pump.

In the present invention, the heat pump further comprises a controller which controls that the opening degree of the second expansion device is larger than or equal to the opening degree of the first expansion device.

In the present invention, the heat pump further comprises a water heater which uses the water heated by the condenser.

In the present invention, the heat pump further comprises a heater which uses the water heated by the condenser.

In another aspect of the present invention, there is provided a heat pump comprising: a main circuit which comprises a rotary compression device including a plurality of compression chambers and a condenser for condensing refrigerant passed through the rotary compressor and an expansion device for expanding refrigerant passed through the condenser and an evaporator for evaporating refrigerant expanded in the expansion device; a water heater which uses water heated by the condenser; a heater which uses water heated by the condenser; a first refrigerant injection flow path which is bypassed at the space between the condenser and the evaporator and injects refrigerant to one of the plurality of compression chambers; and a second refrigerant injection flow path which is bypassed at the space between the condenser and the evaporator and injects refrigerant to the other of the plurality of compression chambers.

As described above, a heat pump according to the present invention comprises a plurality of the compression chambers, and compresses refrigerant with multistage, and injects vapor refrigerant into the space between the plurality of the compression chambers by using the first refrigerant injection flow path and the second refrigerant injection flow path. Performance and efficiency of the heat pump can be improved compared with non-injection, as flow rate of the refrigerant circulating the indoor heat exchanger is increased. Thus heating performance can be improved also in the extremely cold environmental condition such as the cold area by increasing the injection flow rate.

Also, because the heat pump according to the present invention comprises the first refrigerant injection flow path and the second refrigerant injection flow path, refrigerant is injected twice. Thus, as the injection flow rate of the refrigerant is increased, heating capacity can be improved.

Also, the difference between the suction pressure and the discharge pressure of the rotary compressor may be decreased, and thus the reliability and the performance of the rotary compressor can be improved.

Also, by performing a multistage compression, a compression ratio is increased and the discharge temperature of the rotary compression device falls. It is possible to increase the heating performance without limitation of the discharge temperature.

Also, the size of the outdoor unit can be reduced by simplifying the structure of the rotary compression device.

Also, the size of a heat pump system can be reduced by simplifying the structure of the refrigerant injection,

DETAILED DESCRIPTION OF THE PREFERRED EMBODIMENT

Advantages and features of the present invention, and implementation methods thereof will be clarified through following embodiments described with reference to the accompanying drawings.

The present invention will hereinafter be described in detail with reference to the accompanying drawings in which exemplary embodiments of the invention are shown. A heat pump according to an exemplary embodiment of the present invention will hereinafter be described in detail, taking an air conditioner as an example.

Figure 1:
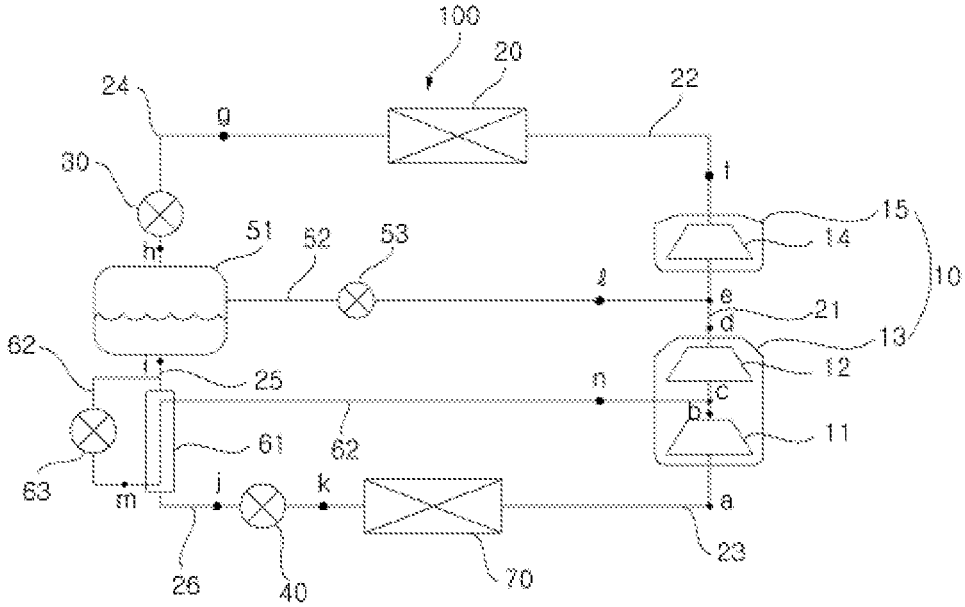
FIG. 1 is a schematic diagram illustrating the configuration of an air conditioner according to a first exemplary embodiment of the present invention.

FIG. 1 is a schematic diagram illustrating a configuration of an air conditioner 100 according to a first exemplary embodiment of the present invention.

Referring to FIG. 1, an air conditioner 100 comprises a main circuit, which comprises a rotary compression device 10 and a condenser 20 for condensing refrigerant passed through the rotary compression device 10 and a first expansion device 30 for expanding refrigerant passed through the condenser 20 and a second expansion device 40 for expanding refrigerant passed through the first expansion device 30 and an evaporator 70 for evaporating refrigerant expanded in the second expansion device 40, and a first refrigerant injection flow path 52 which is bypassed from a space between the condenser 20 and the evaporator 70 and is connected to one of a plurality of the rotary compression chambers for injecting refrigerant, and a second refrigerant injection flow path 62 which is bypassed from a space between the condenser 20 and the evaporator 70 and is connected to the other of a plurality of the rotary compression chambers for injecting refrigerant.

The first expansion device 30 is a first expansion valve 30, which is disposed at a fourth refrigerant circulation flow path 24 stated later and throttles liquid refrigerant flowing into the inside from the condenser 20.

The second expansion device 40 is a second expansion valve 40, which is disposed at a sixth refrigerant circulation flow path 26 stated later and throttles liquid refrigerant flowing into the inside from the second refrigerant injection flow path 62.

The rotary compression device 10 compresses low temperature/low pressure refrigerant into high temperature/high pressure refrigerant. The rotary compression device 10 is a rotary compressor includes a plurality of compression chamber.

In the exemplary embodiment of the present invention, the rotary compression device 10 comprises a two-stage rotary compressor 13, which has a low pressure compression chamber 11 and a high pressure compression chamber 12 in a body, and a one-stage rotary compressor 15, which has a compression chamber 14 in a body and connects with the two-stage rotary compressor 13 in series. In the exemplary embodiment of the present invention, it is stated that the one-stage rotary compressor 15 connects to a discharge port of the two-stage rotary compressor 13, but it is also possible that the two-stage rotary compressor 13 connects to a discharge port of the one-stage rotary compressor 15.

The discharge port of the two-stage rotary compressor 13 is connected to the one-stage rotary compressor 15 by a first refrigerant circulation flow path 21.

The two-stage rotary compressor 13 compresses both the refrigerant flowed from the inside via the second refrigerant injection flow path 62 and the refrigerant flowed from the evaporator 70. And the one-stage rotary compressor 15 compresses the refrigerant which the refrigerant passing through the two-stage rotary compressor 13 and the refrigerant injected from the first refrigerant injection flow path 52 are combined into.

The condenser 20 is an indoor heat exchanger which is disposed in the indoor and exchanges heat of air and refrigerant. A second refrigerant circulation flow path 22 connects an intake port of the condenser 20 and a discharge port of the one-stage rotary compressor 15.

The evaporator 70 is an outdoor heat exchanger which is disposed in the outdoor and exchanges heat of air and refrigerant. A third refrigerant circulation flow path 23 connects an intake port of the rotary compressor 13 and the evaporator 70.

Any one of the first refrigerant injection flow path 52 and the second refrigerant injection flow path 62 may comprise a phase separator 51 which is disposed between the first expansion valve 30 and the second expansion valve 40 and separates the refrigerant expanded at the first expansion valve 30 into liquid refrigerant and vapor refrigerant.

The other of the first refrigerant injection flow path 52 and the second refrigerant injection flow path 62 may comprise an internal heat exchanger 61 which is disposed between the first expansion valve 30 and the second expansion valve 40 and exchanges heat of the refrigerant discharged from the first expansion valve 30.

In the exemplary embodiment of the present invention, it is stated that the first refrigerant injection flow path 52 is the phase separator 52. Also, it is stated that the second refrigerant injection flow path 62 comprises the internal heat exchanger 61.

The phase separator 51 stores refrigerant temporarily, and separates the stored refrigerant into liquid refrigerant and vapor refrigerant, and then discharges only liquid refrigerant to the outside.

The intake port of the phase separator 51 is connected to a discharge port of the condenser 20 and a fourth refrigerant circulation flow path 24. The discharge port of the phase separator 51 is connected to the internal heat exchanger 61 and a fifth refrigerant circulation flow path 25.

The liquid refrigerant discharged from the phase separator 51 flows into the internal heat exchanger 61 through the fifth refrigerant circulation flow path 25. The vapor refrigerant discharged from the phase separator 51 flows in to the intake port of the one-stage rotary compressor 15 through the first refrigerant injection flow path 52.

The first refrigerant injection flow path 52 connects the phase separator 51 and the first refrigerant circulation flow path 21, and guides the vapor refrigerant separated in the phase separator 51 to the intake port of the one-stage rotary compressor 15.

A first refrigerant control valve 53 is disposed at the first refrigerant injection flow path 52, and throttles the refrigerant passing through the first refrigerant injection flow path 52. The flow rate of injected refrigerant can be controlled according to an opening degree of the first refrigerant control valve 53.

A second refrigerant control valve 63 is disposed at the second refrigerant injection flow path 62, and throttles refrigerant passing through the second refrigerant injection flow path 62. The flow rate of injected refrigerant can be controlled according to an opening degree of the second refrigerant control valve 63.

It is possible that the second refrigerant control valve 63 is disposed before the intake port or after the discharge port of the internal heat exchanger 61. In the exemplary embodiment of the present invention, it is stated that the second refrigerant control valve 63 is disposed before the intake port of the internal heat exchanger 61 and throttles refrigerant before refrigerant exchanges heat in the internal heat exchanger.

The second refrigerant injection flow path 62 is bypassed from the fifth refrigerant circulation flow path 25 so that the refrigerant heat-exchanged in the internal heat exchanger 61 is guided to the space between the first compression chamber 11 and the second compression chamber 12.

The internal heat exchanger 61 exchanges heat of the refrigerant passing through the fifth refrigerant circulation flow path 25 with heat of the refrigerant passing through the second refrigerant injection flow path 62. To achieve the heat exchange, it is possible that the internal heat exchanger 61 may be a plate type heat exchanger or a double pipe type heat exchanger.

Figure 2:
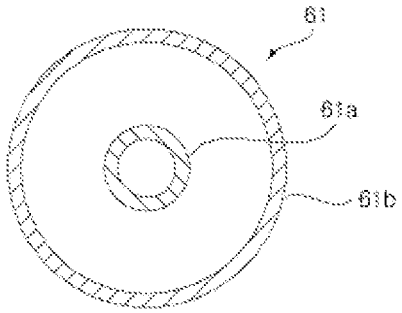
FIG. 2 is a section view illustrating inside of an internal heat exchanger shown in FIG. 1.

FIG. 2 is a section view illustrating inside of an internal heat exchanger shown in FIG. 1.

Referring to FIG. 2, the present invention describes that the internal heat exchanger 61 is a double pipe type heat exchanger which comprises a first refrigerant pipe 61*a* and a second refrigerant pipe 61*b* formed to surround the first refrigerant pipe 61*a*. But, it is also possible that the internal heat exchanger 61 may be a plate type heat exchanger.

The refrigerant of the second refrigerant injection flow path 62 may pass through any one of the first refrigerant pipe 61*a* and the second refrigerant pipe 61*b*, and the refrigerant of the fifth refrigerant circulation flow path 25 may pass through the other of those.

In the present invention, it describes that the refrigerant of the second refrigerant injection flow path 62 passes through the first refrigerant pipe 61*a* and the refrigerant of the fifth refrigerant circulation flow path 25 passes through the second refrigerant pipe 61*b*.

The discharge port of the internal heat exchanger 61 is connected to the intake port of the evaporator 70 and the sixth refrigerant circulation flow path 26.

Figure 3:
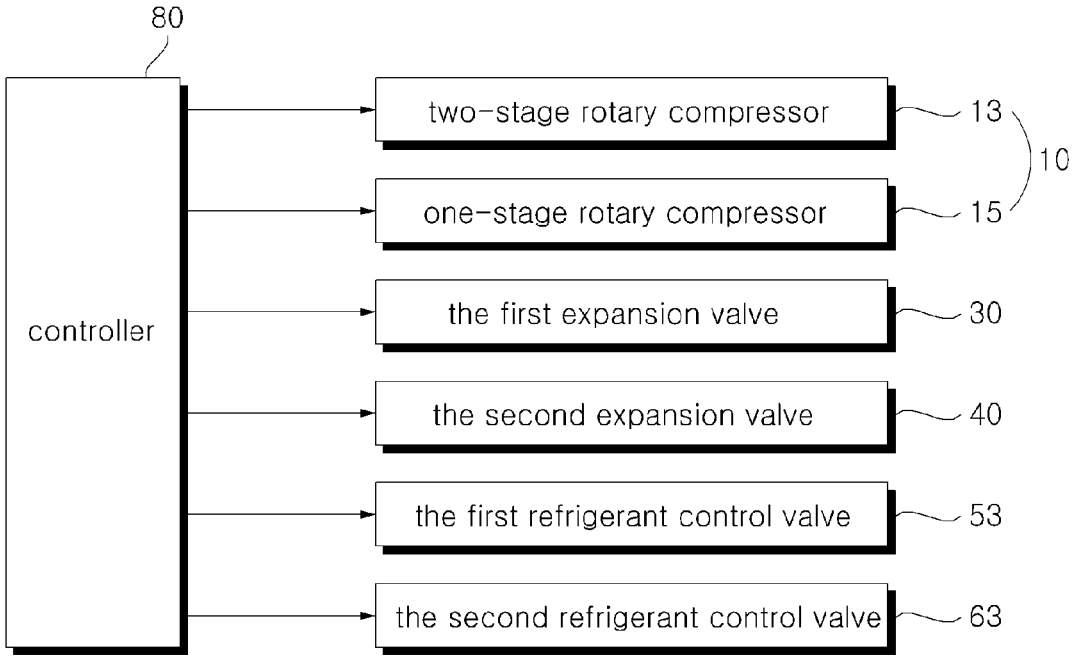
FIG. 3 is a block diagram illustrating the control flow of the air conditioner shown in FIG. 1.

FIG. 3 is a block diagram illustrating a control flow of the air conditioner shown in FIG. 1.

Referring to FIG. 3, the air conditioner 100 further comprises a controller 80 for controlling the overall operation.

The controller 80 controls an opening degree of the first expansion valve 30 and the second expansion valve 40 and the first refrigerant control valve 53 and the second refrigerant control valve 63 according to the heating load of the air conditioner 100.

In the beginning of the operation of the air conditioner 100, the controller 80 controls that the first the first refrigerant control valve 53 and the second refrigerant control valve 63 are closed and that the first expansion valve 30 and the second expansion valve 40 are fully opened. At the beginning of the operation of the air conditioner 100, it can be prevented that liquid refrigerant flows into the rotary compression device 10 by closing the first refrigerant control valve 53 and the second refrigerant control valve 63.

Meanwhile, if the operation of the gas injection is demanded, it is possible that the controller 80 controls that any one of the first refrigerant control valve 53 and the second refrigerant control valve 63 may be opened selectively, or may be opened in serial order, or may be opened simultaneously for quick reaction, according to the heating load such as the outdoor temperature. The controller 80 can control the opening degree of the first refrigerant control valve 53 and the second refrigerant control valve 63 according to the heating load.

Figure 4:
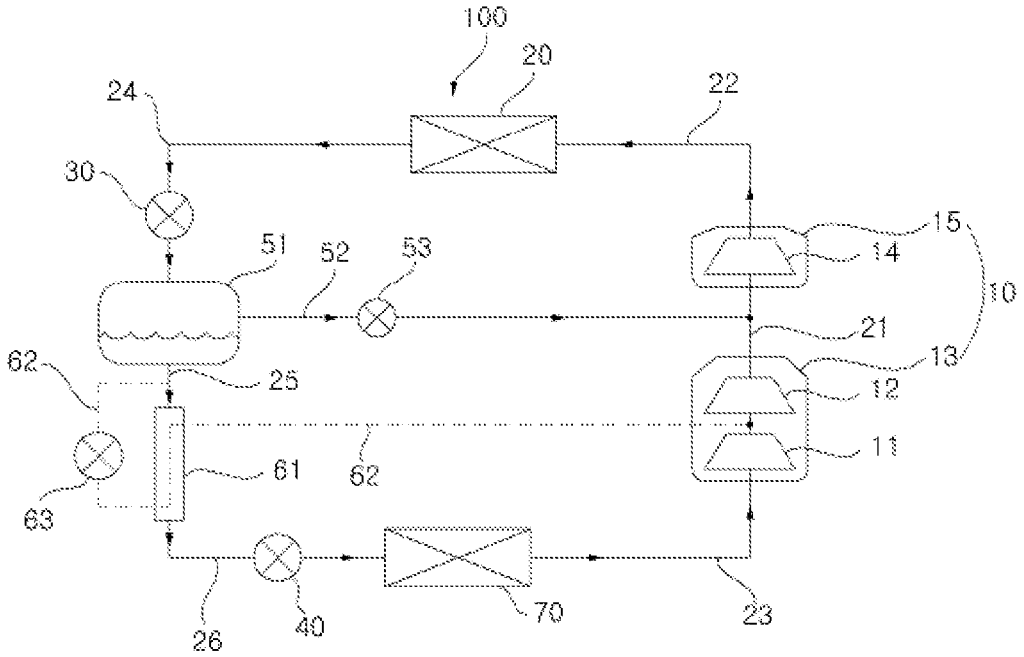
FIG. 4 is a schematic diagram illustrating the condition that a first refrigerant control valve is opened and a second refrigerant control valve is closed in the air conditioner shown in FIG. 1.
Figure 5:
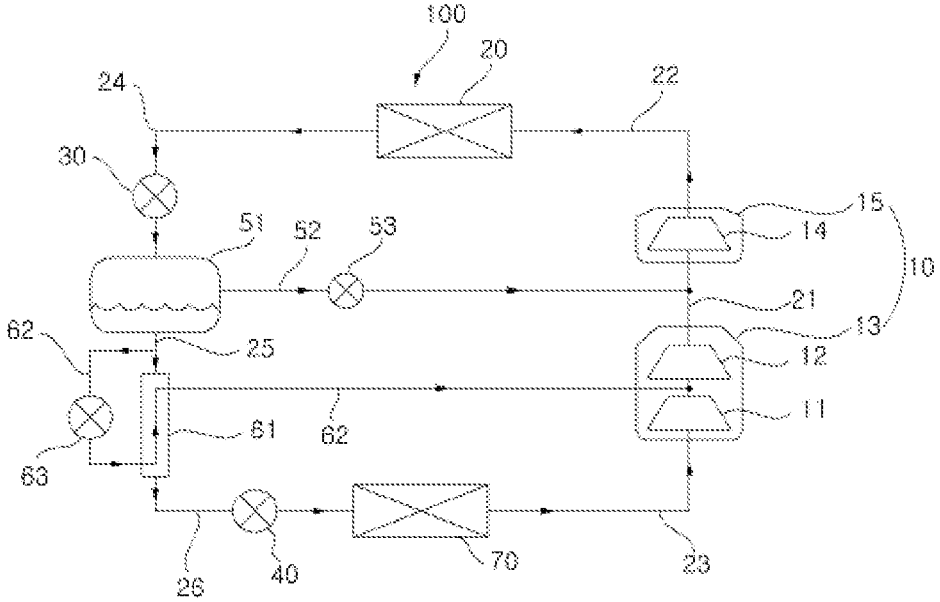
FIG. 5 is a schematic diagram illustrating the condition that a first refrigerant control valve and a second refrigerant control valve are opened in the air conditioner shown in FIG. 1.

FIG. 4 is a schematic diagram illustrating the condition that a first refrigerant control valve is opened and a second refrigerant control valve is closed in the air conditioner 100 shown in FIG. 1. FIG. 5 is a schematic diagram illustrating the condition that a first refrigerant control valve and a second refrigerant control valve are opened in the air conditioner 100 shown in FIG. 1.

If the air conditioner 100 is operated, the controller 80 controls the first expansion valve 30 and the second expansion valve 40 to be fully opened.

Meanwhile, the controller 80 controls that both the first refrigerant control valve 53 and the second refrigerant control valve 63 are closed. In the beginning of the operation of the air conditioner 100, it is possible to prevent that liquid refrigerant flows into the rotary compression device 10 through the first refrigerant injection flow path 52 and the second refrigerant injection flow path 62. Therefore, it is able to improve reliability by closing the first refrigerant control valve 53 and the second refrigerant control valve 63 in the beginning of the operation of the air conditioner 100.

If the operation of the rotary compression device 10 is started, the controller 80 may controls the opening amount of the first expansion valve 30 and the second expansion valve 40 according to the operation of the rotary compression device 10. At this time, the controller 80 has to control that the opening amount of the second expansion valve 40 is larger than or equal to the opening amount of the first expansion valve 30.

The controller 80 controls the degree of superheat for the refrigerant of the air conditioner 100 to be reached to the preset target degree of superheat. And the controller also controls for the refrigerant to be reached to the preset intermediate pressure.

The degree of superheat is the difference between the temperature of the refrigerant sucked into the rotary compression device 10 and the saturation temperature with respect to the evaporating pressure of the evaporator 70. The degree of superheat can be measured by a sensor installed in the evaporator 70 or a sensor installed in the inlet of the rotary compression device 10. Generally, the refrigerant passed through the evaporator 70 does not include liquid refrigerant. But, if the load is suddenly changed, the refrigerant may includes liquid refrigerant.

In that case, if the liquid refrigerant flows into the rotary compression device 10, the rotary compressor 10 may become damaged. To prevent the damage of the rotary compressor 10, when the refrigerant passed through the evaporator 70 flows into the rotary compression device 10, the temperature of the refrigerant has to rise so as to eliminate liquid refrigerant. If the amount of refrigerant flowing into the evaporator 70 is decreased, all refrigerants may be evaporated before the refrigerant passes through the evaporator 70. Vapor refrigerants are continuously heated, the degree of superheat may be increased. Therefore, it can be prevented that the liquid refrigerant flows into the two-stage rotary compressor 13.

On the other hand, if the amount of the refrigerant flowing into the evaporator 70, the degree of superheat may be decreased.

Therefore, the controller 80 controls an opening amount of the second expansion valve 40 installed between the phase separator 51 and the evaporator 70 so as to control the degree of superheat.

The intermediate pressure is a pressure of inside of the phase separator 51. The intermediate pressure can be calculated from the temperature measured by the temperature sensor installed in the first refrigerant injection flow path 52. By adapting the intermediate pressure to reach a preset intermediate pressure, the work of rotary compression device 10 can be reduced, thus the efficiency of the rotary compression device 10 may be increased. By adjusting the amount of the refrigerant supplied to the phase separator 51 from the condenser 20, the intermediate pressure can be adjusted.

Therefore, the controller 80 adjusts the opening amount of the first expansion valve 30 disposed between the phase separator 51 and the condenser 20 in order to adjust the intermediate pressure.

Meanwhile, if gas injection is demanded, the controller 80 may open any one of the first refrigerant control valve 53 and the second refrigerant control valve 63.

The controller 80 may selects and opens any one of the first refrigerant control valve 53 and the second refrigerant control valve 63 according to the heating load such as the outdoor temperature.

Referring to FIG. 4, if a heating load is below the preset load, the controller 80 may open only the first refrigerant control valve 53 and may close the second refrigerant control valve 63.

If only the first refrigerant control valve 53 is opened, the vapor refrigerant separated by the phase separator 51 flows into the intake port of the one-stage rotary compressor 15 through the first refrigerant flow path 52.

The injected refrigerant and the refrigerant passed through the two-stage rotary compressor 13 are mixed and then are compressed in the one-stage rotary compressor 15. The injected refrigerant is vapor refrigerant at the intermediate pressure. The vapor refrigerant and the refrigerant passed through the two-stage rotary compressor 13 are compressed in the one-stage rotary compressor. Therefore, the difference between the suction pressure and the discharge pressure of the one-stage rotary compressor 15 may be decreased, and thus the reliability of the rotary compressor can be increased. Also, by injecting the refrigerant to the one-stage rotary compressor 15, a flow rate of the refrigerant passing through the condenser 20 is increased and heating performance can be improved.

Also, the discharge temperature of the one-stage rotary compressor 14 becomes lower, and then the temperature of the refrigerant which flows to the condenser 20 becomes lower, and then the heating performance may be improved.

Meanwhile, the liquid refrigerant discharged from the phase separator 51 passes through the internal heat exchanger 61. At this time, because the second refrigerant control valve 63 is closed, the heat exchange is not performed in the inside of the internal heat exchanger 61.

Referring to FIG. 5, if the heating load is continuously increased, the controller 80 may also open the second refrigerant control valve 63.

If the second refrigerant control valve 63 is opened, the portion of the liquid refrigerant discharged from the phase separator 51 is bypassed to the second refrigerant injection flow path 62 and then is throttled in the second refrigerant control valve 63 and then flows into the internal heat exchanger 61. Because the temperature and the pressure of the refrigerant throttled by the second refrigerant control valve 63 is dropped, the temperature of the refrigerant throttled is lower than the temperature of the refrigerant flowing in the fifth refrigerant circulation flow path 25.

Therefore, in the internal heat exchanger 61, the refrigerant flowing in the second refrigerant injection flow path 62 and the refrigerant flowing in the fifth refrigerant circulation flow path 25 can exchange the heat of the each. In the internal heat exchanger 61, the refrigerant flowing in the fifth refrigerant circulation flow path 25 lose the heat, the refrigerant flowing in the second refrigerant injection flow path 62 absorbs the heat.

The refrigerant which has lost the heat in the internal heat exchanger 61 is throttled in the second expansion valve 40 and then flows into the evaporator 70. The refrigerant in the evaporator 70 is evaporated by heat exchange with ambient air, and the evaporated refrigerant is introduced into the two-stage compressor 13.

Meanwhile, at least some of the refrigerant which absorbs the heat in the internal heat exchanger 61 is evaporated and becomes two phase refrigerant mixed liquid and vapor or superheated vapor refrigerant or vapor refrigerant. The ratio of liquid refrigerant to vapor refrigerant can be minimized by controlling the opening degree of the second refrigerant control valve 63. The flow rate of the refrigerant injected from the internal heat exchanger 61 is more than the flow rate of the refrigerant injected from the phase separator 51. Total flow rate of the refrigerant injecting into the compressor is increased, and thus the heating performance can be improved.

The refrigerant flowed into the second refrigerant injection flow path 62 is injected into the space between the low pressure compression chamber 11 and the high pressure compression chamber 12.

The injected refrigerant and the refrigerant coming from the low pressure compression chamber 11 are mixed and then compressed in the high pressure compression chamber. Because the injected and compressed refrigerant is refrigerant at the intermediate pressure, the difference between the suction pressure and the discharge pressure of the high pressure compression chamber 12 can be decreased.

As stated above, because refrigerant is injected twice through the first refrigerant injection flow path 52 and the second refrigerant injection flow path 62, the flow rate can be increased. The heating performance can be improved by an increase of flow rate.

Meanwhile, in the exemplary embodiment of the present invention, it describes that the heat pump is an air conditioner. However, the present invention is not limited thereto, the heat pump can be applied to a cooling and heating air conditioner comprising a 4-way valve.

Figure 6:
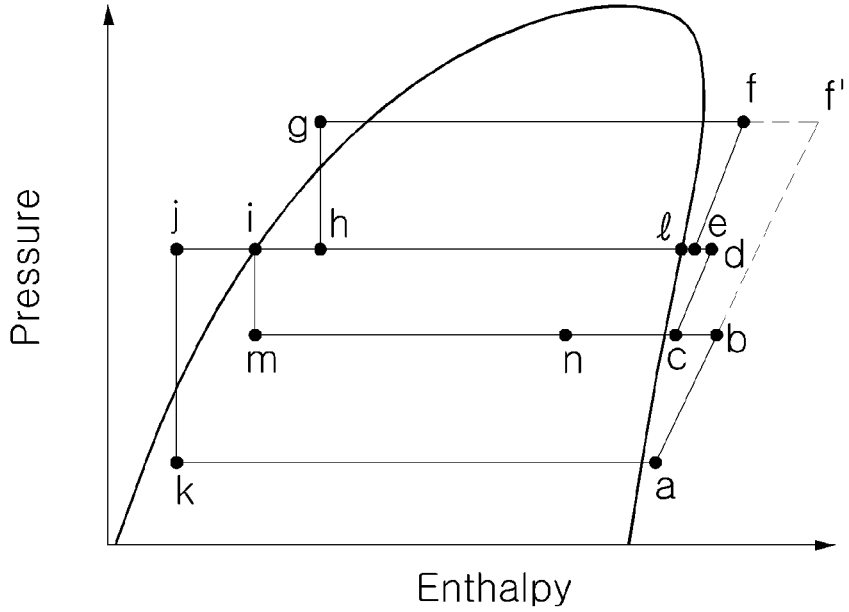
FIG. 6 is the mollier diagram (p-h diagram) illustrating the refrigeration cycle of the air conditioner shown in FIG. 1.

FIG. 6 is a mollier diagram(p-h diagram) illustrating a refrigeration cycle of the air conditioner 100 shown in FIG. 1.

Referring to FIG. 1 and FIG. 6, the refrigerant of low pressure at 'a' point, is once compressed in the low pressure compression chamber 11 of the two-stage rotary compressor, the compressed refrigerant becomes the refrigerant of high temperature and high pressure at 'b' point.

The refrigerant (at 'b' point) compressed in the low pressure compression chamber 11 is mixed with the refrigerant (at 'n' point) injected through the second refrigerant injection flow path 62. The mixed refrigerant (at 'c' point) is compressed again in the high pressure compression chamber 12. At this time, as shown in FIG. 6, the refrigerant injecting through the second refrigerant injection flow path 62 may be a wet vapor condition such as a two-phase refrigerant which mixed a liquid refrigerant with a vapor refrigerant or a superheated vapor or a vapor refrigerant.

The refrigerant (at 'd' point) compressed in the high pressure compression chamber 12 is mixed with the refrigerant (at 'l' point) injected through the first refrigerant injection flow path 52, and the mixed refrigerant (at 'e' point) is compressed in the compression chamber 14 of the second rotary compressor 15. The third compression is performed in the compression chamber. The compressed refrigerant is shown at 'f' point of FIG. 6.

The compressed refrigerant (at 'f' point) is condensed in the condenser 20 and becomes a liquid refrigerant (at 'g' point). The liquid refrigerant is expanded in the first expansion valve 30. The expanded refrigerant (at 'h' point) is a mixed condition which mixed a liquid and vapor. The expanded refrigerant (at 'h' point) is separated into a liquid and a vapor in the phase separator 51. The saturated vapor refrigerant (at 'l' point) separated by the phase separator 51 is injected. The portion of the liquid refrigerant (at 'i' point) separated by the phase separator 51 passes through the internal heat exchanger 61 and becomes a liquid refrigerant (at 'j' point), and the rest of the liquid refrigerant absorbs heat from the internal heat exchanger 61 and becomes a wet vapor refrigerant (at 'm' point).

The liquid refrigerant (at 'j' point) is expanded in the second expansion valve 40 and becomes a low temperature and low pressure condition.

Referring to FIG. 6, a discharge temperature(T_f) of compressor measured in a case that refrigerant is compressed three times in the rotary compression device 10 is lower than a discharge temperature(T_f') of compressor measured in a case that refrigerant is once compressed. Therefore, a reliability can be improved.

Figure 7:
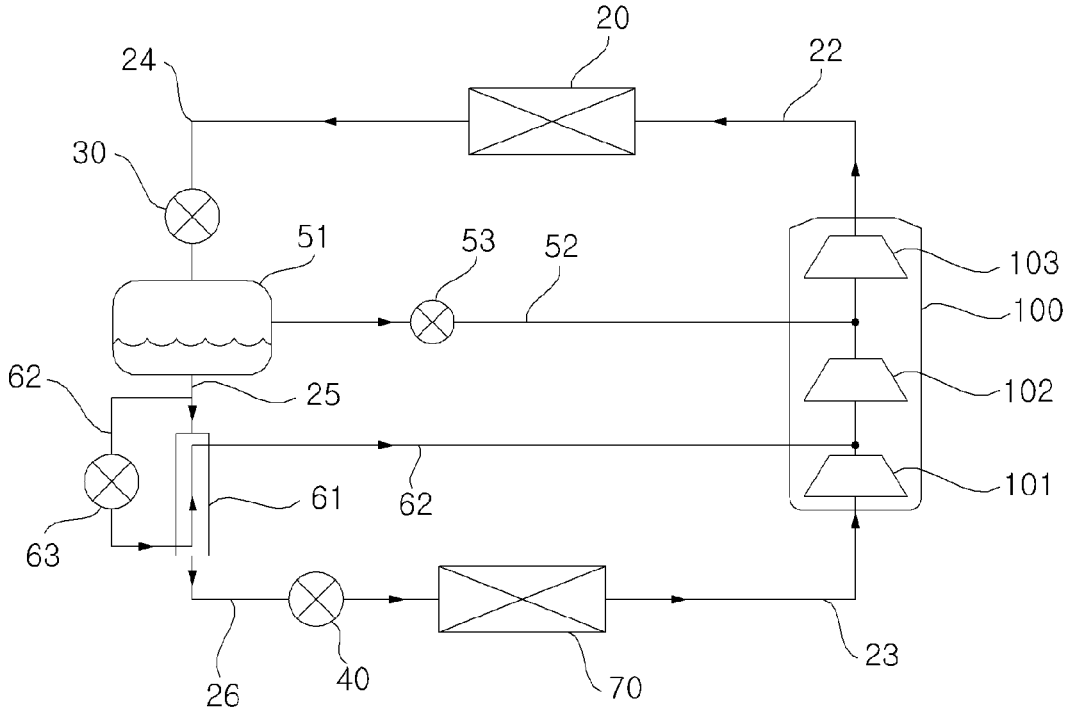
FIG. 7 is a schematic diagram illustrating the configuration of an air conditioner according to the second exemplary embodiment of the present invention.

FIG. 7 is a schematic diagram illustrating a configuration of an air conditioner according to a second exemplary embodiment of the present invention.

Referring to FIG. 7, an air conditioner according to a second exemplary embodiment of the present invention comprises a rotary compression device 100 which has three compression chambers such as a first compression chamber 101 and the second compression chamber 102 and the third compression chamber 103 formed in a body. Detailed description about the same elements as the first exemplary embodiment is skipped. A same number in figures indicates the same element.

The first refrigerant injection flow path 52 is connected between the second compression chamber 102 and the third compression chamber 103. The second refrigerant injection flow path 62 is connected between the first compression chamber 101 and the second compression chamber 102.

Therefore, in the second compression chamber 102, the injected refrigerant passed through the internal heat exchanger 61 and the discharged refrigerant passed through the first compression chamber 101 are mixed and compressed. Also, in the third compression chamber 103, the injected vapor refrigerant passed through the phase separator 51 and the discharged refrigerant passed through the second compression chamber 102 are mixed and compressed.

As stated above, the rotary compression device 100 comprises three compression chambers in a body, and the refrigerant may be injected into each compression chamber. Thus, a heating performance can be improved also in cold area, and the size of the outdoor unit can be reduced by simplifying the structure of the rotary compression device 100.

Figure 8:
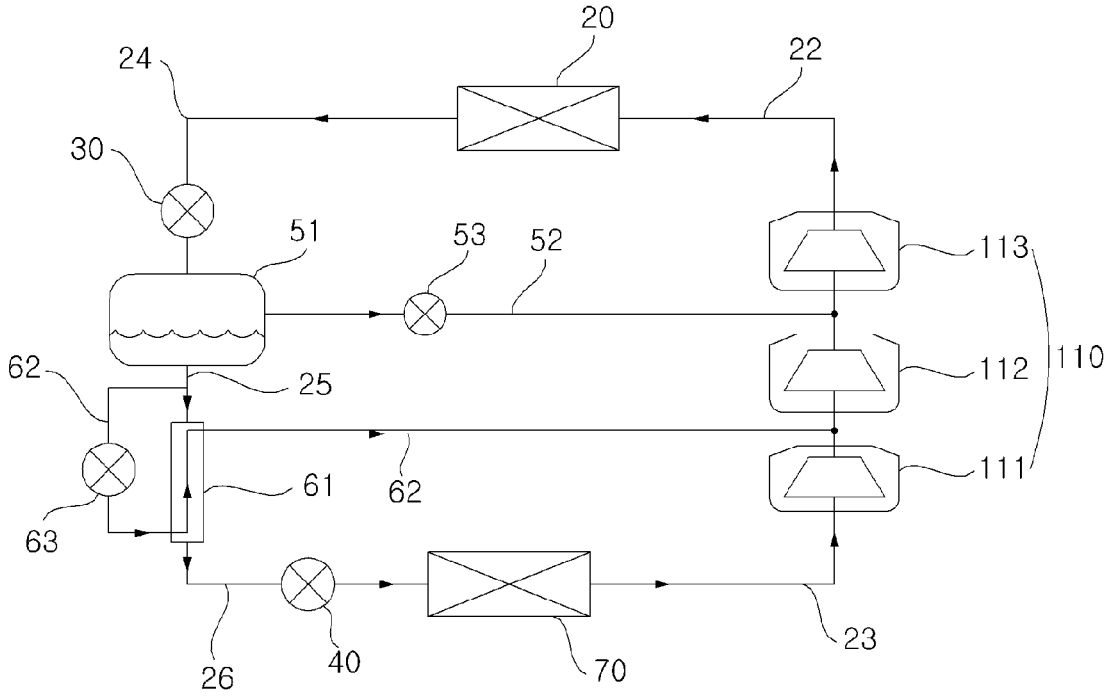
FIG. 8 is a schematic diagram illustrating the configuration of an air conditioner according to a third exemplary embodiment of the present invention.

FIG. 8 is a schematic diagram illustrating a configuration of an air conditioner according to a third exemplary embodiment of the present invention.

Referring to FIG. 8, an air conditioner according to a third exemplary embodiment of the present invention comprises a rotary compression device 110 comprising three one-stage rotary compressors which are connected in series and has a compression chamber in a body. Detailed description about the same elements as the first exemplary embodiment is skipped. A same number in figures indicates the same element.

The rotary compression device 110 comprises three one-stage rotary compressors that a first rotary compressor 111 and the second rotary compressor 112 and the third rotary compressor 113 are connected in series.

The first refrigerant injection flow path 52 is connected between the second rotary compressor 112 and the third rotary compressor. The second refrigerant injection flow path 62 is connected between the first rotary compressor 111 and the second rotary compressor 112.

Therefore, in the second rotary compressor 112, the injected refrigerant passed through the internal heat exchanger 61 and the discharged refrigerant passed through the first rotary compressor 111 are mixed and compressed. Also, in the third rotary compressor, the injected vapor refrigerant passed through the phase separator 51 and the discharged refrigerant passed through the second rotary compressor 112 are mixed and compressed.

Figure 9:
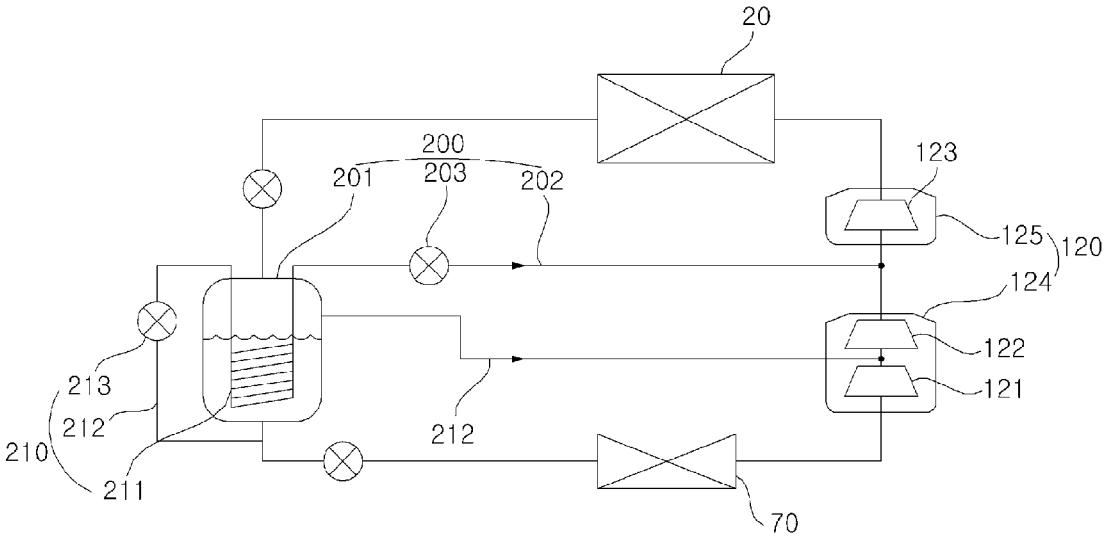
FIG. 9 is a schematic diagram illustrating the configuration of an air conditioner according to a fourth exemplary embodiment of the present invention.

FIG. 9 is a schematic diagram illustrating a configuration of an air conditioner according to a fourth exemplary embodiment of the present invention.

Referring to FIG. 9, an air conditioner 1 according to the fourth exemplary embodiment of the present invention comprises a rotary compression device 120, which comprises a two-stage rotary compressor including a low pressure compression chamber 121 and a high pressure compression chamber 122 and a one-stage rotary compressor including a compression chamber 124, and a first injection device 200, which comprises a phase separator 201 and a first refrigerant injection flow path 202 bypassed from the phase separator 201 and connected to a intake port of the one-stage rotary compressor 125, and a second injection device 210, which comprises a internal heat exchanger 211 disposed at the inside of the phase separator 201 for absorbing a heat generated by the phase separator 201 and a second refrigerant injection flow path 212 connected between the low pressure chamber 121 and the high pressure chamber 122 from the internal heat exchanger 211.

Detailed description about the same elements as the first exemplary embodiment is skipped. A same number in figures indicates the same element.

A first refrigerant control valve 203 is disposed at the first refrigerant injection flow path 202 so as to throttle the refrigerant being injected.

A second refrigerant control valve 213 is disposed at the second refrigerant injection flow path 212 so as to throttle the refrigerant being injected.

The phase separator 201 and the internal heat exchanger 211 are formed in a body so that a structure of air conditioner can be simplified. Also, a heat generated from the inside of the phase separator 201 can be useful.

Figure 10:
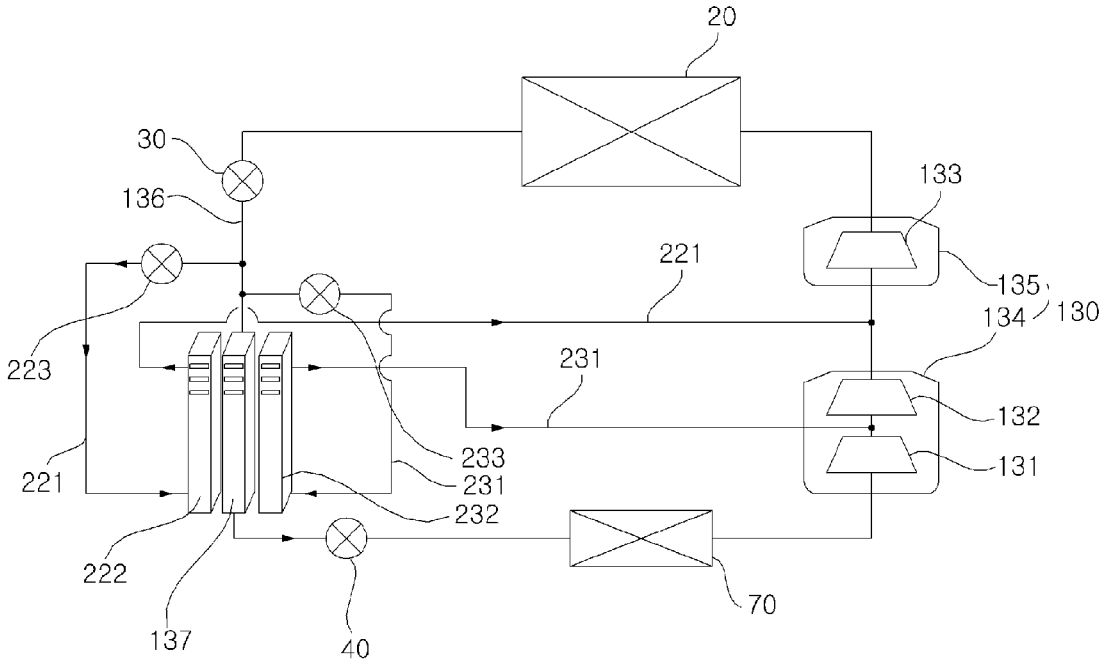
FIG. 10 is a schematic diagram illustrating the configuration of an air conditioner according to a fifth exemplary embodiment of the present invention.

FIG. 10 is a schematic diagram illustrating a configuration of an air conditioner according to a fifth exemplary embodiment of the present invention.

Referring to FIG. 10, an air conditioner according to the fifth exemplary embodiment of the present invention comprises a two-stage rotary compressor 133, which includes a low pressure compression chamber 131 and a high pressure compression chamber 132, and a one-stage rotary compressor 135, which includes a compression chamber 134, and a third heat exchanger 137, which is disposed at the refrigerant circulation flow path 136 connecting the first expansion valve 30 and the second expansion valve 40.

A first refrigerant injection flow path 221 comprises a first heat exchanger 222, which is disposed at the first refrigerant injection flow path 221 for exchanging a heat of the refrigerant passing through the first refrigerant injection flow path 221 and a heat of the refrigerant passing through the refrigerant circulation flow path 136, and a first refrigerant control valve 223 for throttling the refrigerant passing through the first refrigerant injection flow path 221.

A second refrigerant injection flow path 231 comprises a second heat exchanger 232, which is disposed at the second refrigerant injection flow path 231 for exchanging heat of the refrigerant passing through the second refrigerant injection flow path 231 and heat of the refrigerant passing through the third heat exchanger 137, and a second refrigerant control valve 233 for throttling the refrigerant passing through the second refrigerant injection flow path 231.

The first heat exchanger 222 and the second heat exchanger 232 and the third heat exchanger 137 are respectively in the shape of a plate. The first heat exchanger 222 and the second heat exchanger 232 and the third heat exchanger 137 are formed in a body. The first heat exchanger 222 is disposed at the one side of the third heat exchanger 137, and the second heat exchanger 232 is disposed at the other side of the third heat exchanger 137.

Because three heat exchangers of plate type are disposed side by side, a structure can be simplified.

Figure 11:
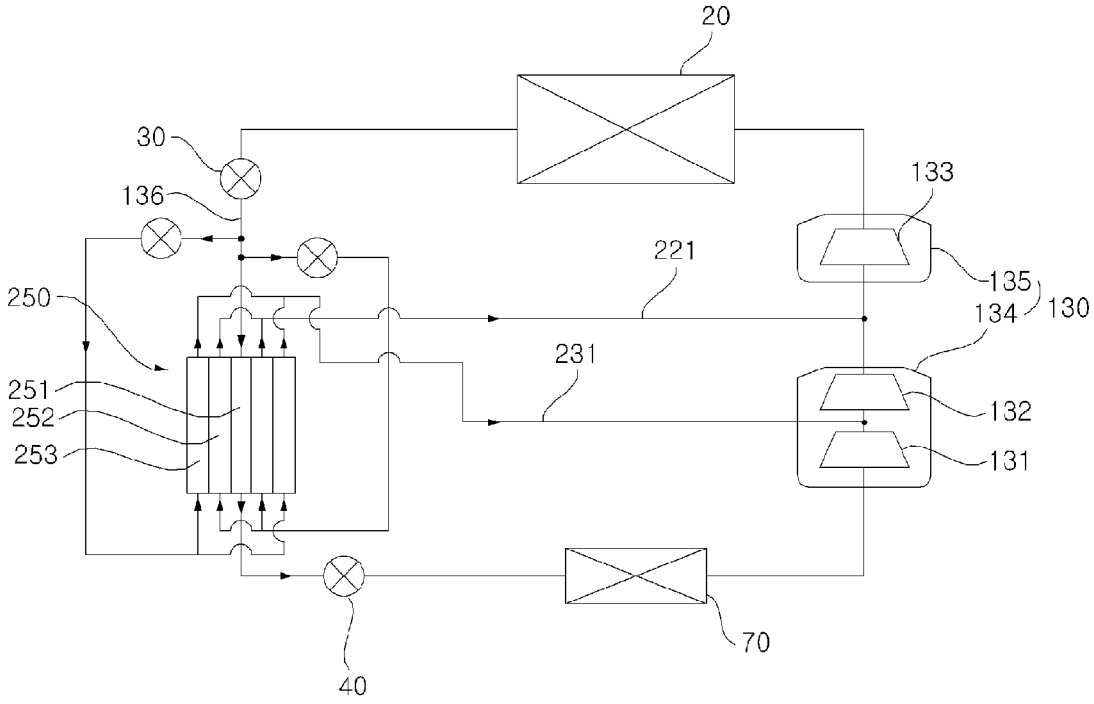
FIG. 11 is a schematic diagram illustrating the configuration of an air conditioner according to a sixth exemplary embodiment of the present invention.
Figure 12:
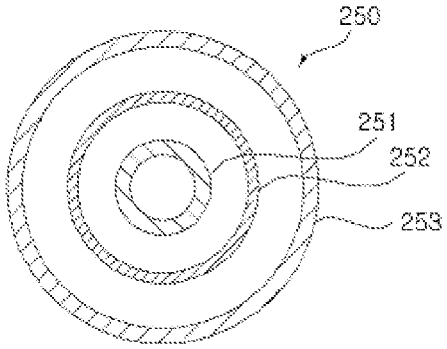
FIG. 12 is a section view illustrating a triple pipe heat exchanger shown in FIG. 11.

FIG. 11 is a schematic diagram illustrating a configuration of an air conditioner according to a sixth exemplary embodiment of the present invention. FIG. 12 is a section view illustrating a triple pipe heat exchanger shown in FIG. 11.

Referring to FIG. 11 and FIG. 12, an air conditioner according to the sixth exemplary embodiment of the present invention comprises a triple pipe heat exchanger 250 which is disposed at the space between the first expansion device 30 and the second expansion device 40. Detailed description about the same elements as the fifth exemplary embodiment is skipped. A same number in figures indicates the same element.

The triple pipe heat exchanger 250 comprises a first refrigerant pipe 251 forming the first refrigerant injection flow path 221, and a second refrigerant pipe 252 surrounding the first refrigerant pipe 251 and introducing refrigerant passed through the first expansion device 30, and a third refrigerant pipe 253 surrounding the second refrigerant pipe 252 and forming the second refrigerant injection flow path 231.

As stated above, by using the triple pipe heat exchanger 250 comprising the first refrigerant pipe 251 and the second refrigerant pipe 252 and the third refrigerant pipe 253, a structure of the air conditioner can be simplified.

Figure 13:
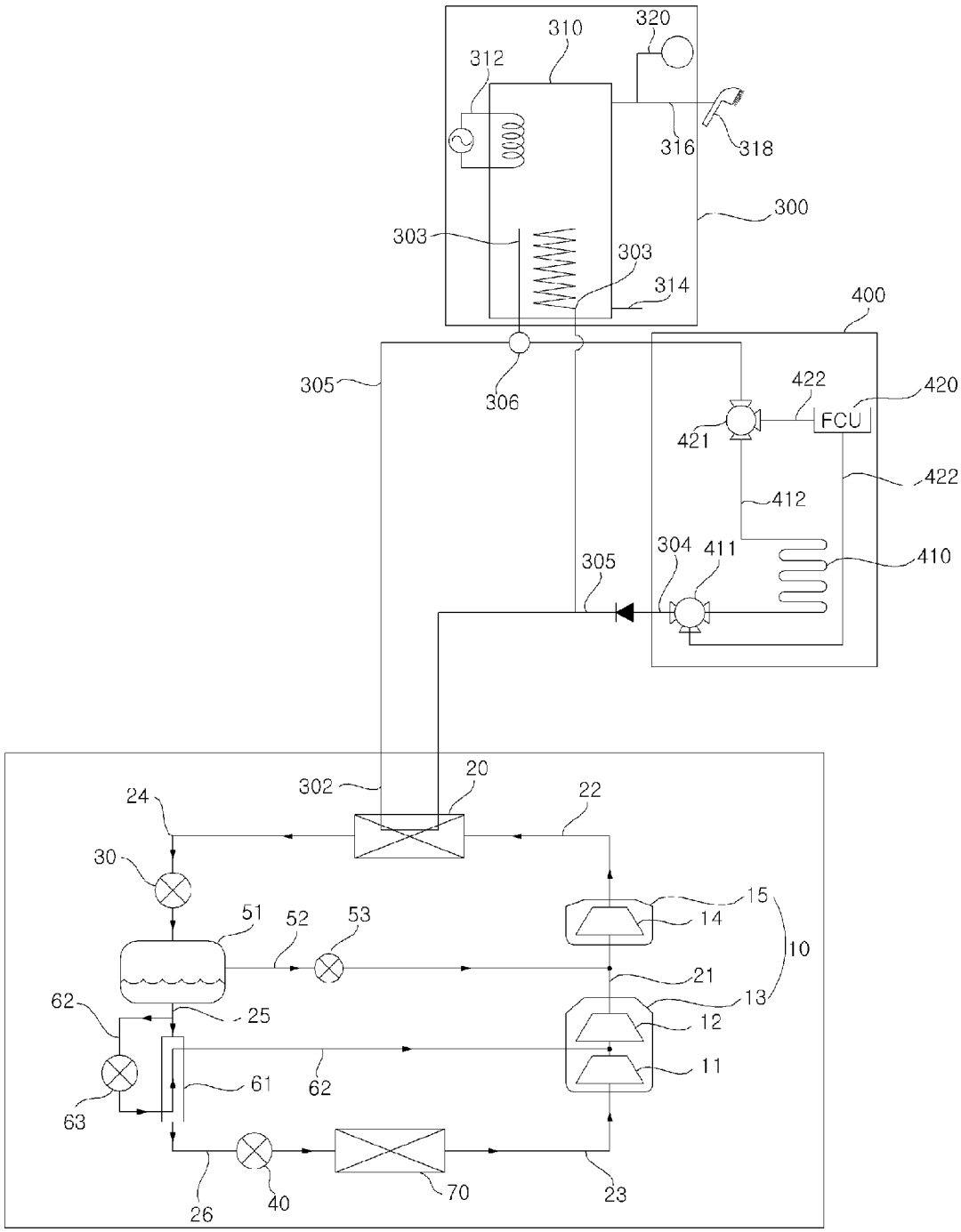
FIG. 13 is a schematic diagram illustrating the configuration of an air conditioner according to a seventh exemplary embodiment of the present invention.

FIG. 13 is a schematic diagram illustrating a configuration of an air conditioner according to a seventh exemplary embodiment of the present invention.

Referring to FIG. 13, a heat pump according to the seventh exemplary embodiment of the present invention comprises an air conditioner 100, and a water heater 300 which uses water heated by the condenser 20 for heating the water, and a heater 400 which uses water heated by the condenser 20 for heating the floor. Detailed description about the same elements as the first exemplary embodiment is skipped. A same number in figures indicates the same element.

The water heater 300 and the heater 400 are connected to the condenser 20 by a hot water circulation flow path 301. The hot water circulation flow path 301 connects the condenser 20 and the water heater 300 and the heater 400 so that hot water heated by the condenser passes through any one of the water heater 300 and the heater 400 and then returns to the condenser 20.

The hot water circulation flow path 301 comprises an indoor unit pipe 302 which is disposed in the inside of the air conditioner 100, and a water heater pipe 303 for introducing a hot water to the water heater 300, and a heater pipe 304 for introducing a hot water to the heater 400, and a connection pipe 305 for connecting the indoor unit pipe 302 to the water heater pipe 303 and the heater pipe 304.

A hot water control valve 306 is installed at the connection pipe 305 for introducing a hot water to any one of the water heater pipe 303 and the heater pipe 304. The water heater 300 is a device for supplying a hot water needed to wash and bath or dish-washing. The water heater 300 comprises a hot water tank 310 for storing water and a sub heater 312 installed in the hot water tank 310.

The hot water tank 310 is connected with a cold water inlet 314 for introducing cold water to the hot water tank 310 and a hot water outlet 316 for discharging hot water.

The hot water outlet 316 may be connected with a hot water discharge apparatus 318 such as a shower. The hot water outlet 316 may be connected with the cold water inlet 320 so as to discharge cold water to the hot water discharge apparatus 318.

The heater 400 comprises a floor heater 410 for heating a floor in the room and an air heater 412 for heating an air in the room.

The floor heater 410 may be laid under the floor by the meander line.

The air heater 412 may comprise a fan coil unit or a radiator.

A hot water control valve for heating 411/421 may be installed at the heater pipe 304 for introducing the hot water to any one of the floor heater 410 and the air heater 420.

The floor heater 410 is connected to the hot water control valve for heating 411 and the floor heating pipe 412, and the air heater 420 is connected to the hot water control valve for heating 421 and the air heating pipe 422.

If the hot water control valve 306 is controlled with a heating mode, the water heated by the condenser 30 passes through the indoor pipe 302 and the connection pipe 305 in order, and heats any one of the floor heater 410 and the air heater 420, and passes through the heater pipe 304 and the connection pipe 305 and the indoor pipe 302 in order, and then is returned to the condenser 20.

If the hot water control valve for heating 411/412 is controlled with a air heating mode, hot water passes through the air heating pipe 422 and the air heater 420 and air heating pipe 422 in order, and is discharged to the heating pipe 304. Meanwhile, if it is controlled with a floor heating mode, hot water passes through the floor heating pipe 412 and the floor heater 411 and the floor heating pipe 412 in order, and is discharged to the heating pipe 304.

In case the heat pump comprises the water heater 300 and the heater 400, the refrigerant is also injected through the first refrigerant injection flow path 52 and the second injection flow path 62. Therefore, by injecting refrigerant, a flow rate of the refrigerant can be increased and a performance of the water heating and the heating can be improved.

Although the present invention has been described with reference to the embodiments shown in the drawings, these are merely illustrative, and those skilled in the art will understand that various modifications and equivalent other embodiments of the present invention are possible. Consequently, the true technical protective scope of the present invention must be determined based on the technical spirit of the appended claims.

What is claimed is:

1. A heat pump comprising:

a main circuit which comprises a rotary compression device having a plurality of compression chambers and a condenser for condensing refrigerant passed through the rotary compression device and an expansion device for throttling refrigerant passed through the condenser and an evaporator for evaporating refrigerant expanded by the expansion device;

a first refrigerant injection flow path which is bypassed at the space between the condenser and the evaporator and injects refrigerant to one of the plurality of compression chambers; and a second refrigerant injection flow path which is bypassed at the space between the condenser and the evaporator and injects refrigerant to the other of the plurality of compression chambers, wherein the first refrigerant injection flow path comprises a first heat exchanger which exchanges heat of the refrigerant flowing from the expansion device to the evaporator for heat of the refrigerant bypassed from the expansion device to the first refrigerant injection flow path;

and the second refrigerant injection flow path comprises a second heat exchanger which exchanges heat of the refrigerant flowing from the expansion device to the evaporator for heat of the refrigerant bypassed from the expansion device to the second refrigerant injection flow path;

and the first heat exchanger and the second heat exchanger which are respectively in the shape of a plate are formed to one unit.

2. The heat pump of claim 1, wherein, the rotary compression device comprises a rotary compressor which has a plurality of compression chambers formed in a body, and each of the first refrigerant injection flow path and the second refrigerant injection flow path injects refrigerant to the spaces between the plurality of compression chambers.

3. The heat pump of claim 1, wherein the rotary compression device comprises a first rotary compressor which has a low pressure compression chamber and a high pressure compression chamber in a body and a second rotary compressor which has a compression chamber in a body, and one of the first refrigerant injection flow path and the second refrigerant injection flow path injects refrigerant to the space between a low pressure compression chamber and a high pressure compression chamber, and the other of the first refrigerant injection flow path and the second refrigerant injection flow path injects refrigerant to the compression chamber of the second rotary compressor.

4. The heat pump of claim 1, wherein the rotary compression device comprises three rotary compressors which are connected in series and have a compression chamber in a body respectively, and the first refrigerant injection flow path and the second refrigerant injection flow path respectively inject refrigerant to each of the spaces between the three rotary compressors.

5. The heat pump of claim 1, wherein the expansion device comprises a first expansion device which is disposed between the condenser and the first refrigerant injection flow path and a second expansion device which is disposed between the second refrigerant injection flow path and the evaporator, and the first refrigerant injection flow path is connected between the first expansion device and the second expansion device, and the second refrigerant injection flow path is connected between the first refrigerant injection flow path and the second expansion device.

6. The heat pump of claim 5, further comprising a controller which controls that the opening degree of the second expansion device is larger than or equal to the opening degree of the first expansion device.

7. The heat pump of claim 1, wherein any one of the first refrigerant injection flow path and the second refrigerant injection flow path comprises an internal heat exchanger which exchanges heat of refrigerant expanded at the expansion device and a refrigerant control valve which throttles refrigerant passed through the internal heat exchanger.

8. he heat pump of claim 7, wherein the internal heat exchanger comprises a first refrigerant pipe and a second refrigerant pipe which is formed to surround the first refrigerant pipe, and any one of the refrigerant flowing from the expansion device to the evaporator and the refrigerant injecting into a plurality of compression chambers passes through the first refrigerant pipe and the other refrigerant of those passes through the second refrigerant pipe.

9. The heat pump of claim 1, wherein the first refrigerant injection flow path further comprises a first refrigerant control valve which throttles the refrigerant passing through the first refrigerant injection flow path;

and the second refrigerant injection flow path further comprises a second refrigerant control valve which throttles the refrigerant passing through the second refrigerant injection flow path.

10. The heat pump of claim 1, wherein, each of the first refrigerant injection flow path and the second refrigerant injection flow path comprises a first refrigerant control valve and a second refrigerant control valve respectively which throttles the refrigerant injected into the rotary compression device, and the heat pump further comprises a controller which controls opening amount of the first refrigerant control valve and the second refrigerant control valve.

11. The heat pump of claim 10, wherein if the heat pump is started, the controller controls that the expansion device is started and the first refrigerant control valve and the second refrigerant control valve are closed, and then, if the start control of the expansion device is finished and the refrigerant injection is demanded, the controller controls that the first refrigerant control valve and the second refrigerant control valve are started to be opened.

12. The heat pump of claim 10, wherein the controller controls that at least any one of the first refrigerant control valve and the second refrigerant control valve is selectively opened according to the demand load of the heat pump.

13. The heat pump of claim 10, wherein the controller controls that the first refrigerant control valve and the second refrigerant control valve is opened in sequence according to the demand load of the heat pump.

* * * * *